US009340021B2

(12) United States Patent
Gejima et al.

(10) Patent No.: US 9,340,021 B2
(45) Date of Patent: May 17, 2016

(54) LIQUID EJECTION HEAD AND RECORDING DEVICE USING THE SAME

(71) Applicant: KYOCERA Corporation, Kyoto-shi, Kyoto (JP)

(72) Inventors: Kenko Gejima, Kirishima (JP); Toshifumi Kubo, Kirishima (JP)

(73) Assignee: Kyocera Corporation, Kyoto (JP)

( * ) Notice: Subject to any disclaimer, the term of this patent is extended or adjusted under 35 U.S.C. 154(b) by 0 days.

(21) Appl. No.: 14/763,903

(22) PCT Filed: Jan. 29, 2014

(86) PCT No.: PCT/JP2014/051915

§ 371 (c)(1),
(2) Date: Jul. 28, 2015

(87) PCT Pub. No.: WO2014/119604

PCT Pub. Date: Aug. 7, 2014

(65) Prior Publication Data

US 2015/0360467 A1 Dec. 17, 2015

(30) Foreign Application Priority Data

Jan. 31, 2013 (JP) ..... 2013-016830

(51) Int. Cl.
*B41J 2/045* (2006.01)
*B41J 2/14* (2006.01)
*B41J 2/055* (2006.01)

(52) U.S. Cl.
CPC ..... *B41J 2/1433* (2013.01); *B41J 2/055* (2013.01); *B41J 2/14233* (2013.01); *B41J 2002/14419* (2013.01); *B41J 2002/14459* (2013.01); *B41J 2202/11* (2013.01); *B41J 2202/12* (2013.01)

(58) Field of Classification Search
CPC ..... B41J 2/055; B41J 2/1433; B41J 2/14233; B41J 2/14201; B41J 2/1607; B41J 2/1612
See application file for complete search history.

(56) References Cited

U.S. PATENT DOCUMENTS

2005/0140754 A1 6/2005 Hirota et al.
2005/0157104 A1 7/2005 Hirota et al.

(Continued)

FOREIGN PATENT DOCUMENTS

EP 1541362 A1 6/2005
EP 1547775 A1 6/2005
EP 1798040 A1 6/2007
EP 1839881 A2 10/2007

(Continued)

OTHER PUBLICATIONS

International Search Report, PCT/JP2014/051915, Mar. 11, 2014, 2 pgs.

*Primary Examiner* — Juanita D Jackson
(74) *Attorney, Agent, or Firm* — Volpe and Koenig, P.C.

(57) ABSTRACT

A liquid ejection head includes: a liquid ejection head body; and a reservoir, wherein the reservoir includes: a reservoir flow passage; and a branched flow passage, the branched flow passage extends in one direction, and is communicated with the liquid ejection head body at both end portions thereof, and in viewing the liquid ejection head from a reservoir side, at least one of the reservoir flow passage and the branched flow passage in the vicinity of a connection portion where the reservoir flow passage and the branched flow passage are communicated with each other is bent such that an angle made by the reservoir flow passage and the branched flow passage approximates a right angle.

10 Claims, 6 Drawing Sheets

(56) References Cited

U.S. PATENT DOCUMENTS

| | | | | |
|---|---|---|---|---|
| 2007/0139498 | A1 | 6/2007 | Chikamoto et al. | |
| 2007/0229602 | A1 | 10/2007 | Taira et al. | |
| 2007/0263036 | A1 * | 11/2007 | Ito | B41J 2/14209 347/54 |
| 2008/0158323 | A1 | 7/2008 | Nishizaki et al. | |

FOREIGN PATENT DOCUMENTS

| | | | |
|---|---|---|---|
| JP | 2005-169839 | A | 6/2005 |
| JP | 2005-186375 | A | 7/2005 |
| JP | 2007-160822 | A | 6/2007 |
| JP | 2007-268868 | A | 10/2007 |
| JP | 2008-162144 | A | 7/2008 |

* cited by examiner

LIQUID EJECTION HEAD AND RECORDING DEVICE USING THE SAME

TECHNICAL FIELD

The present invention relates to a liquid ejection head for ejecting liquid droplets and a recording device using the liquid ejection head.

BACKGROUND ART

Conventionally, as a type of liquid ejection head, there has been proposed a liquid ejection head which includes, besides a liquid ejection head body which includes a flow passage member having an ejection port, and a piezoelectric actuator which applies pressure to a liquid so as to eject the liquid from the ejection port, a reservoir for temporarily storing the liquid so as to stably supply the liquid to the liquid ejection head body (see Patent Document 1, for example).

Further, in a reservoir flow passage of a reservoir in a liquid ejection head described in Patent Document 2, a liquid supplied from an end of the elongated liquid ejection head is fed to a liquid ejection head body at a center portion of the liquid ejection head.

PRIOR ART DOCUMENTS

Patent Documents

Patent Document 1: Japanese Patent Laid-open Publication No. 2005-169839

Patent Document 2: Japanese Patent Laid-open Publication No. 2008-162144

SUMMARY OF THE INVENTION

Problems to be Solved by the Invention

However, with respect to the reservoir described in patent document 2, an ejected liquid is supplied to the reservoir from an end portion of a liquid ejection head, advances to a center portion of the reservoir flow passage in the longitudinal direction, advances toward a head body side (lower side) at the center portion, and is branched to both ends in the longitudinal direction from the head body side. Accordingly, in flow passages after branching, an amount of liquid in the direction directed to the direction where a liquid advances in the reservoir flow passage is slightly increased. Therefore, at the time of supplying a liquid into the liquid ejection head firstly, spreading of the liquid becomes non-uniform thus giving rise to a drawback that air bubbles are liable to remain in the flow passage, a drawback that an ejection speed on one side of the liquid ejection head is increased at the time of ejecting the liquid or a drawback that an ejection amount of the liquid is increased.

Accordingly, it is an object of the present invention to provide a liquid ejection head having small irregularities in an ejection characteristic depending on a position in the inside of a liquid ejection head, and a recording device using the liquid ejection head.

Solutions to the Problems

In order to solve this object, a liquid ejection head according to the present invention includes: a liquid ejection head body; and a reservoir mounted on the liquid ejection head body and supplying a liquid to the liquid ejection head body, wherein the reservoir includes: a reservoir flow passage; and a branched flow passage arranged closer on a liquid ejection head body side than the reservoir flow passage, the reservoir flow passage extends in one direction, opens to the outside at one end thereof, and is communicated with the branched flow passage at the other end thereof, the branched flow passage extends in the above-mentioned one direction, and is communicated with the liquid ejection head body at both ends portion thereof, and in viewing the liquid ejection head from a reservoir side, at least one of the reservoir flow passage and the branched flow passage in the vicinity of a connection portion where the reservoir flow passage and the branched flow passage are communicated with each other is bent such that an angle made by the reservoir flow passage and the branched flow passage approximates a right angle.

A recording device according to the present invention includes: the liquid ejection head; a conveyance part which conveys a recording medium to the liquid ejection head; and a control part which controls the liquid ejection head.

Effects of the Invention

According to the present invention, it is possible to reduce irregularities in an ejection characteristic by reducing the difference in flows of a liquid after being divided by branched flow passages.

EMBODIMENTS FOR CARRYING OUT THE INVENTION

Figure 1:
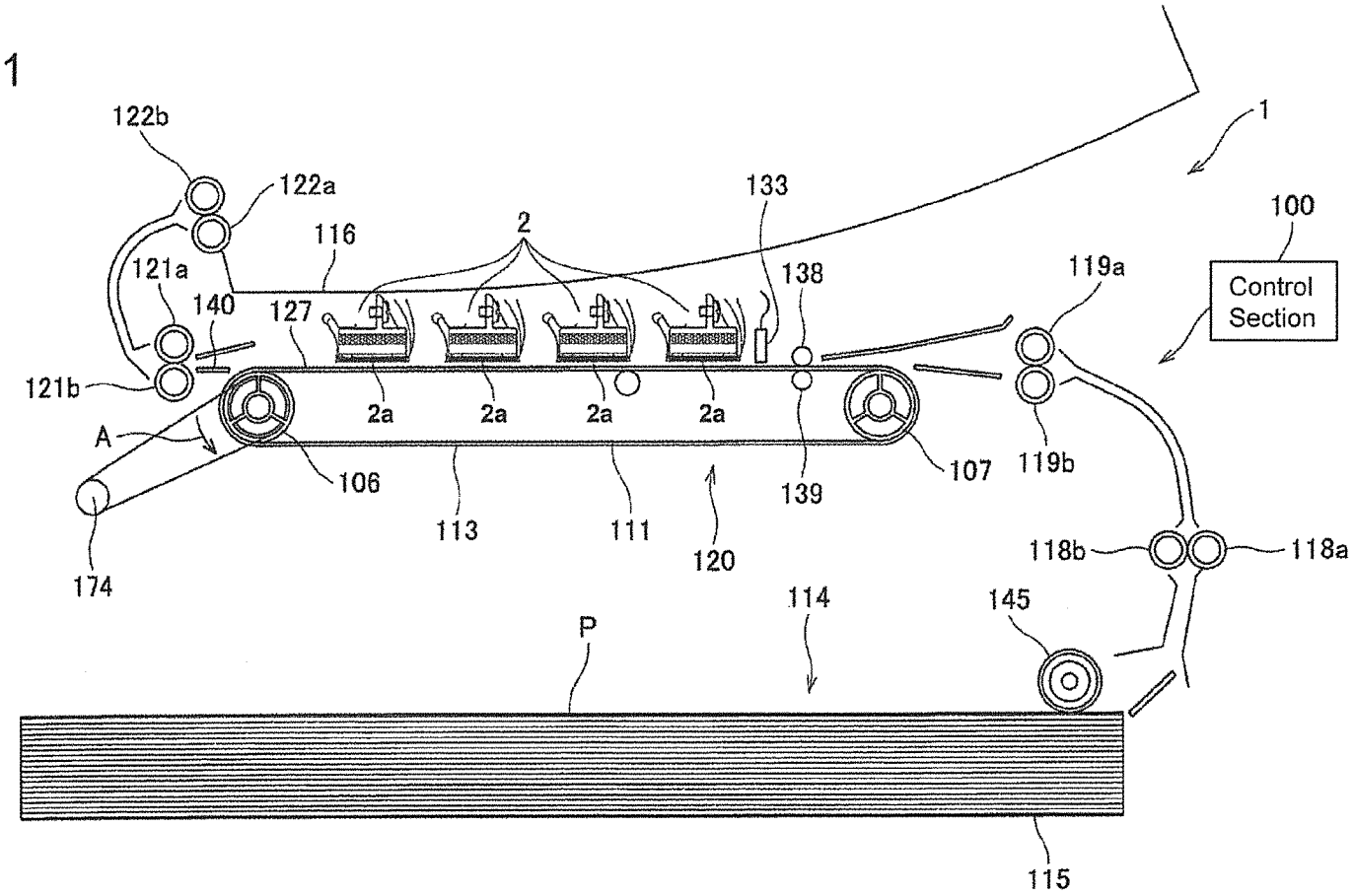
FIG. 1 is a schematic constitutional view of a color inkjet printer which is a recording device including a liquid ejection head according to one embodiment of the present invention.

FIG. 1 is a schematic constitutional view of a color inkjet printer which is a recording device including a liquid ejection head according to one embodiment of the present invention. The color inkjet printer 1 (hereinafter referred to as the printer 1) includes liquid ejection heads 2. The liquid ejection heads 2 are fixed to the printer 1. The liquid ejection head 2 has an elongated shape elongated in the direction extending toward a depth side from a viewer's side in FIG. 1. This lengthwise direction is also referred to as a long side direction.

In the printer 1, along a conveyance path of a printing sheet P, a sheet feeding unit 114, a conveyance unit 120 and a sheet receiving part 116 are sequentially arranged. Further, the printer 1 includes a control part 100 for controlling operations of respective parts of the printer 1 such as the liquid ejection heads 2 and the sheet feeding unit 114.

The sheet feeding unit 114 includes: a sheet accommodating case 115 which can accommodate a plurality of printing sheets P therein: and a sheet feeding roller 145. The sheet feeding roller 145 can feed the printing sheet P placed on an uppermost position among the printing sheets P stored in the sheet accommodating case 115 in a stacked manner one by one.

Two pairs of feeding rollers 118*a*, 118*b* and 119*a*, 119*b* are arranged between the sheet feeding unit 114 and the conveyance unit 120 along the conveyance path of the printing sheet P. The printing sheets P fed from the sheet feeding unit 114 are guided by these feeding rollers and are further fed to the conveyance unit 120.

The conveyance unit 120 includes an endless conveyance belt 111 and two belt rollers 106, 107. The conveyance belt 111 extends between and is wound around the belt rollers 106, 107. A length of the conveyance belt 111 is adjusted such that the conveyance belt 111 is stretched with a predetermined tension when the conveyance belt 111 extends between and is wound around two belt rollers. With such a configuration, the conveyance belt 111 is stretched without being slackened along two planes parallel to each other which include a common tangent of two belt rollers. Out of these two planes, the plane closer to the liquid ejection heads 2 forms a conveyance surface 127 along which the printing sheet P is conveyed.

As shown in FIG. 1, a conveyance motor 174 is connected to the belt roller 106. The conveyance motor 174 can rotate the belt roller 106 in a direction indicated by an arrow A. The belt roller 107 can be also rotated in an interlocking manner with the conveyance belt 111. Accordingly, by rotating the belt roller 106 by driving the conveyance motor 174, the conveyance belt 111 moves in the direction indicated by the arrow A.

In the vicinity of the belt roller 107, a nip roller 138 and a nip receiving roller 139 are arranged in a state where these rollers 138, 139 nip the conveyance belt 111. The nip roller 138 is biased downwardly by a spring not shown in the drawing. The nip receiving roller 139 disposed below the nip roller 138 receives the nip roller 138 biased downwardly by way of the conveyance belt 111. Two nip rollers are rotatably mounted and are rotated in an interlocking manner with the conveyance belt 111.

The printing sheet P fed to the conveyance unit 120 from the sheet feeding unit 114 is nipped between the nip roller 138 and the conveyance belt 111. With such a configuration, the printing sheet P is pressed to the conveyance surface 127 of the conveyance belt 111 and is fixedly mounted on the conveyance surface 127. Then, the printing sheet P is conveyed in the direction toward a position where the liquid ejection heads 2 are mounted along with the rotation of the conveyance belt 111. Tacky silicon rubber may be applied to an outer peripheral surface 113 of the conveyance belt 111. With such a configuration, the printing sheet P can be fixedly mounted on the conveyance surface 127 with certainty.

The liquid ejection head 2 has a head body 2*a* on a lower end thereof. A lower surface of the head body 2*a* forms an ejection port surface 4-1 on which a large number of ejection ports through which a liquid is ejected are formed.

Liquid droplets (inks) of four colors are ejected from the ejection ports formed in one liquid ejection head 2. The ejection ports formed in the liquid ejection head 2 for ejecting liquid droplets of respective colors are arranged at equal intervals in one direction (the direction parallel to the printing sheet P and orthogonal to the conveyance direction of the printing sheet P, and the long side direction of the liquid ejection head 2) and hence, respective colors can be printed in one direction without gaps. Colors of liquids ejected from the liquid ejection head 2 are respectively magenta (M), yellow (Y), cyan (C) and black (K), for example. The liquid ejection head 2 is arranged such that a slight gap is formed between the ejection port surface 4-1 formed of the lower surface of the head body 2*a* and the conveyance surface 127 of the conveyance belt 111.

The printing sheet P conveyed by the conveyance belt 111 passes a gap formed between the liquid ejection heads 2 and the conveyance belt 111. During such an operation, liquid droplets are ejected to an upper surface of the printing sheet P from the head bodies 2*a* which form the liquid ejection heads 2. With such a configuration, a color image is formed on the upper surface of the printing sheet P based on image data stored in the control part 100.

Between the conveyance unit 120 and the sheet receiving part 116, a peeling plate 140, and two pairs of feeding rollers 121*a*, 121*b* and 122*a*, 122*b* are arranged. The printing sheet P on which a color image is printed is conveyed to the peeling plate 140 by the conveyance belt 111. At this stage of the operation, the printing sheet P is peeled off from the conveyance surface 127 by a right end of the peeling plate 140. Then, the printing sheet P is fed to the sheet receiving part 116 by the feeding rollers 121*a* to 122*b*. In this manner, the printing sheets P on which printing is finished are sequentially fed to the sheet receiving part 116 and are stacked in the sheet receiving part 116.

A sheet surface sensor 133 is arranged between the liquid ejection head 2 disposed at a most upstream side in the conveyance direction of the printing sheet P and the nip roller 138. The sheet surface sensor 133 is formed of a light emitting element and a light receiving element, and can detect a distal end position of the printing sheet P on the conveyance path. A detection result obtained by the sheet surface sensor 133 is transmitted to the control part 100. The control part 100 can, based on the detection result transmitted from the sheet surface sensor 133, control the liquid ejection head 2, the conveyance motor 174 and the like such that the conveyance of the printing sheet P and the printing of an image synchronize with each other.

Figure 2:
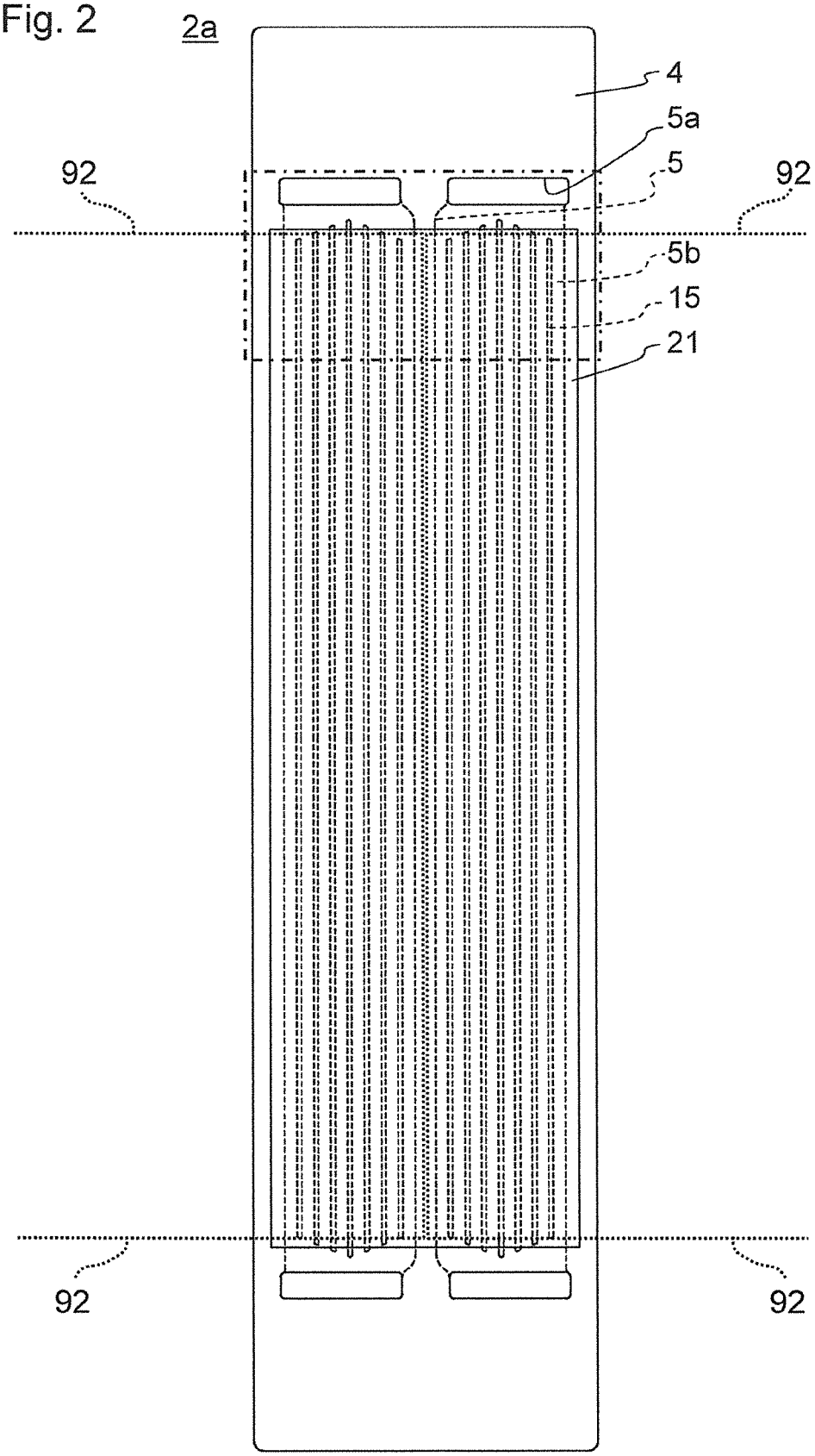
FIG. 2 is a plan view of a head body of the liquid ejection head shown in FIG. 1.
Figure 3:
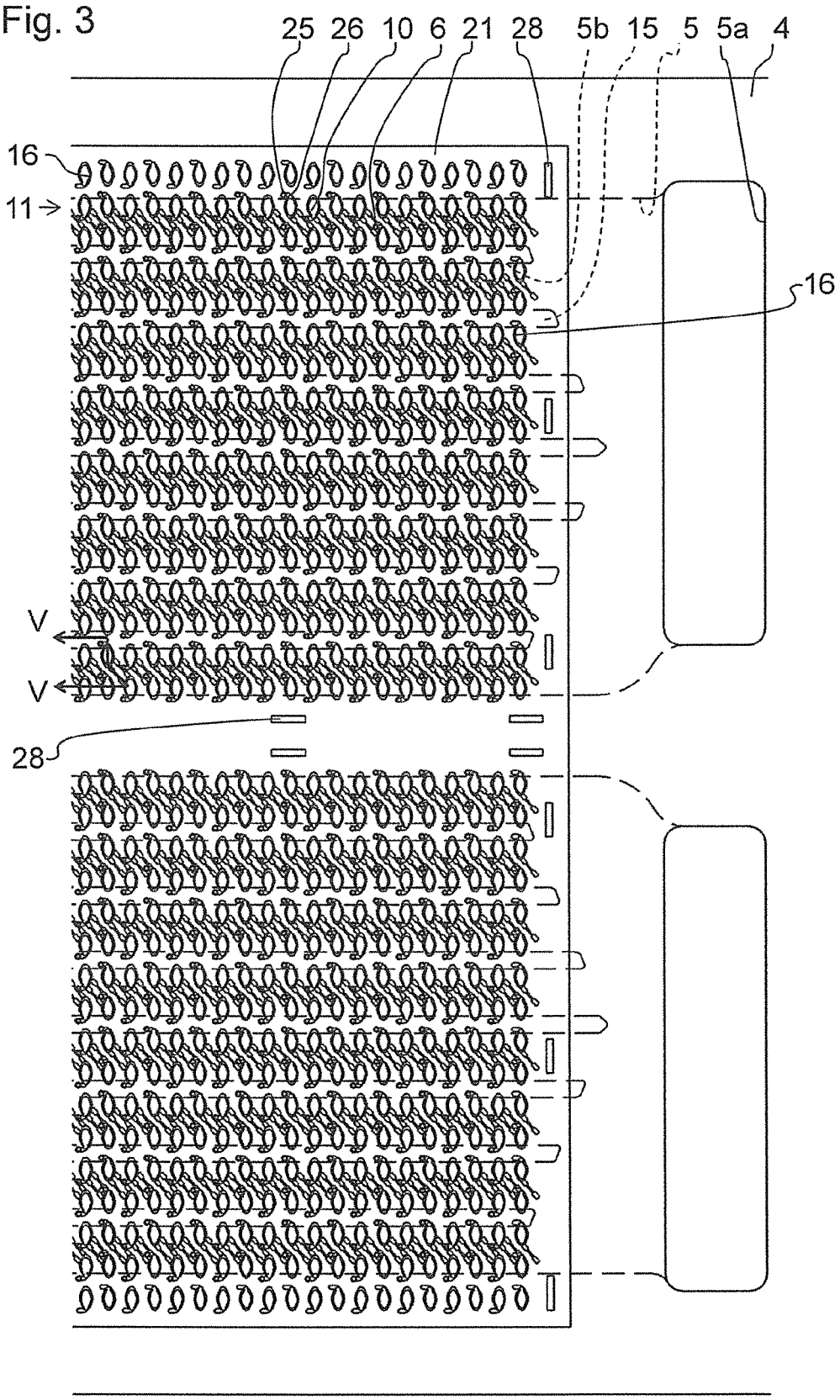
FIG. 3 is an enlarged view of a region in FIG. 2 surrounded by a chained line, and is also a view where some flow passages are omitted for the sake of description.
Figure 4:
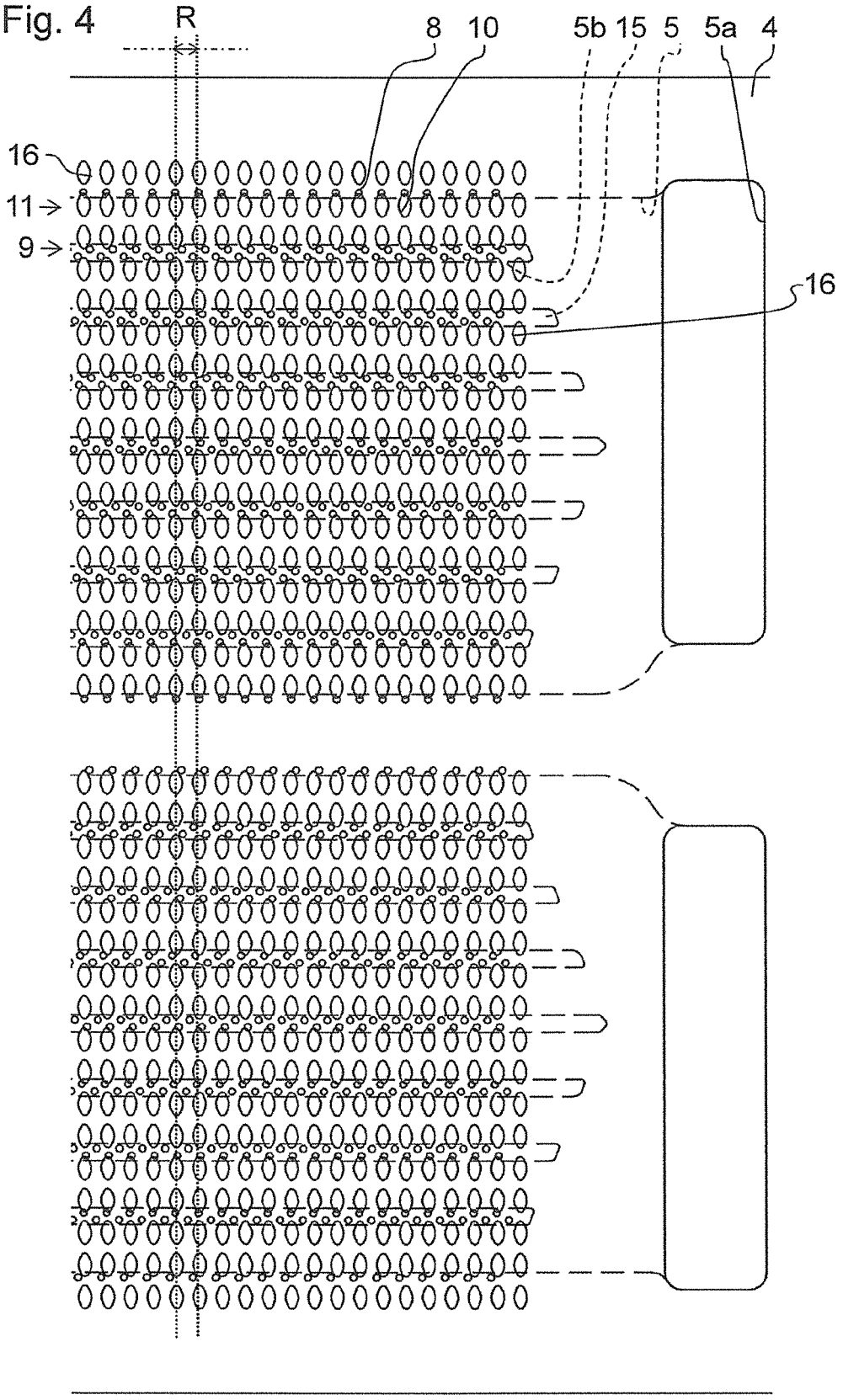
FIG. 4 is an enlarged view of the region in FIG. 2 surrounded by a chained line, and is also a view where some flow passages are omitted for the sake of description.
Figure 5:
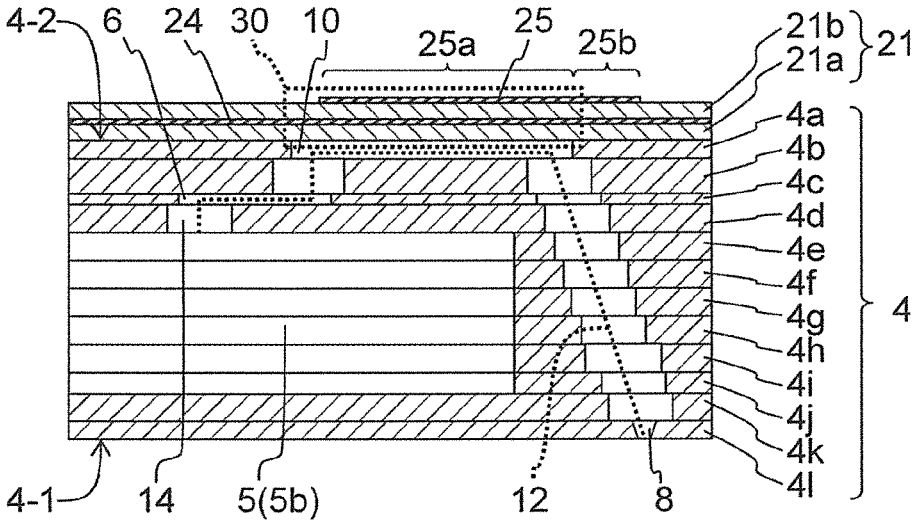
FIG. 5 is a longitudinal cross-sectional view taken along a line V-V in FIG. 3.
Figure 6A:
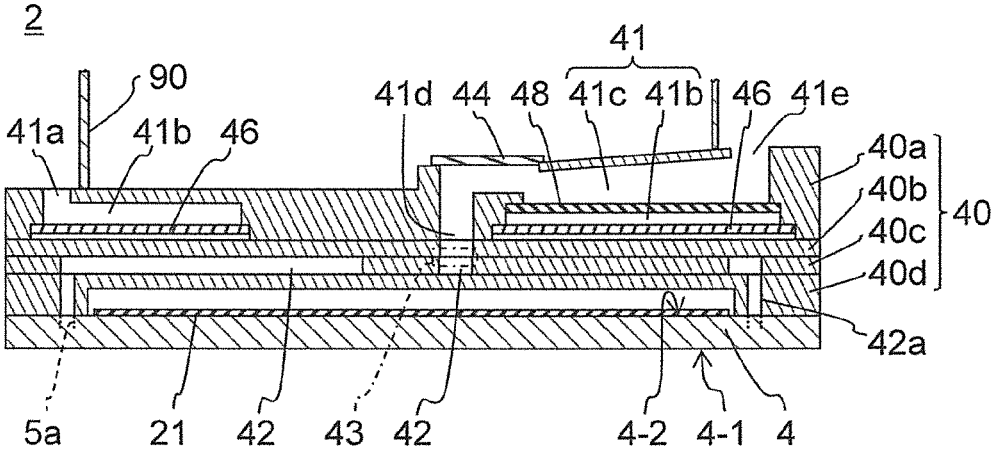
FIG. 6(*a*) is a longitudinal cross-sectional view of a portion of the liquid ejection head shown in FIG. 1 taken along a line X-X shown in FIG. 6 (*b*), and FIG. 6 (*b*) to FIG. 6(*e*) are plan views of members which form a reservoir.
Figure 6B:
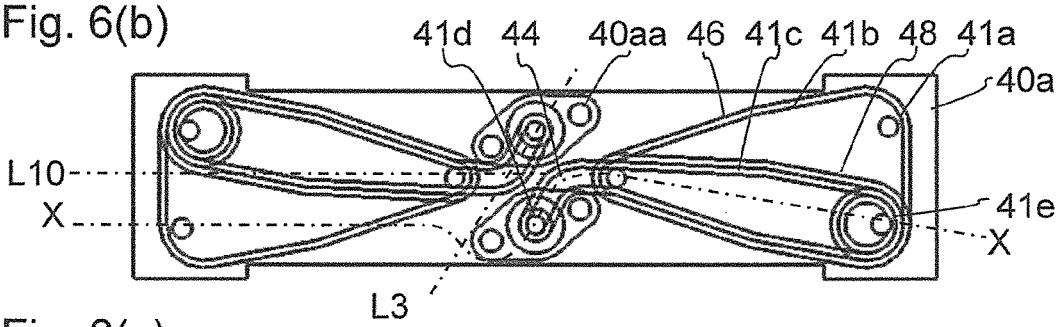
Figure 6C:
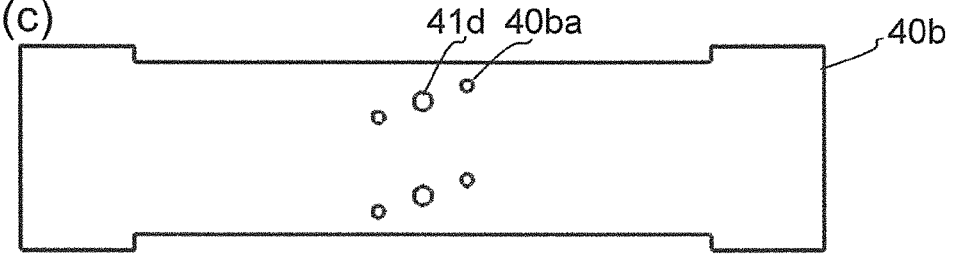
Figure 6D:
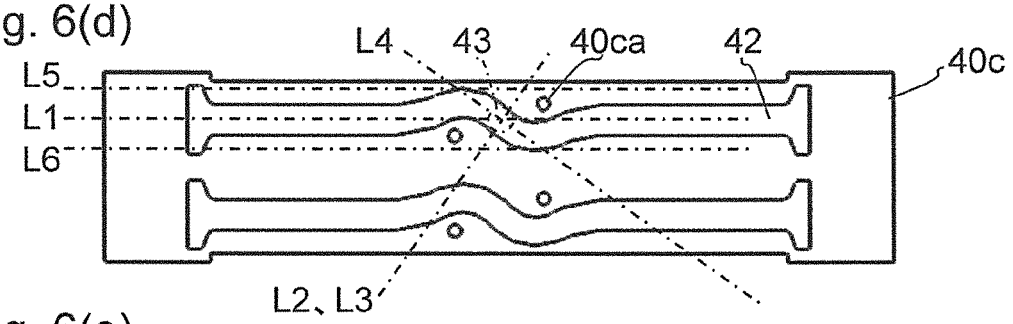
Figure 6E:
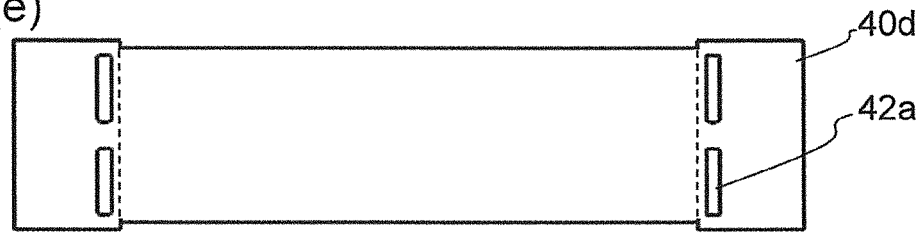

Next, the liquid ejection head 2 according to the present invention is described. FIG. 2 is a plan view of the head body 2*a*. FIG. 3 is an enlarged view of a region in FIG. 2 surrounded by a chained line, and is also a plan view where some flow passages are omitted for the sake of description. FIG. 4 is an enlarged view of the region in FIG. 2 surrounded by a chained line, and is also a view where some flow passages which are different from the corresponding flow passages shown in FIG. 3 are omitted for the sake of description. In FIG. 3 and FIG. 4, for the sake of facilitating the understanding of the drawings, diaphragms 6, ejection ports 8, pressurizing chambers 10 and the like which are disposed below a piezoelectric actuator substrate 21 and should be depicted by a broken line are depicted by a solid line. Further, the ejection ports 8 shown in FIG. 4 are depicted with a diameter larger than an actual diameter for the sake of facilitating the finding of the positions of the ejection ports 8. FIG. 5 is a longitudinal cross-sectional view taken along a line V-V shown in FIG. 3. FIG. 6(*a*) is a longitudinal cross-sectional view of the liquid ejection head 2 taken along a line X-X shown in FIG. 6(*b*). FIG. 6(*b*) to FIG. 6(*e*) are plan views of members which form a reservoir 40.

The liquid ejection head 2 includes the head body 2*a*, the reservoir 40 and a metal-made housing 90. Both the head body 2*a* and the reservoir 40 are elongated in one direction and are bonded to each other along with each other. The head body 2*a* includes a flow passage member 4 and the piezoelectric actuator substrate 21 in which displacement elements (pressurizing portions) 30 are incorporated. The reservoir 40 includes a reservoir flow passage 41 and branched flow passages 42.

The flow passage member 4 which form the head body 2*a* includes: a manifold 5 which is a common flow passage; a plurality of pressurizing chambers 10 which are communicated with the manifold 5; and a plurality of ejection ports 8 which are communicated with the plurality of pressurizing chambers 10 respectively. The pressurizing chambers 10 open at an upper surface of the flow passage member 4 so that the upper surface of the flow passage member 4 forms a pressurizing chamber surface 4-2. Openings 5*a* which are communicated with the manifold 5 are formed in both ends of the upper surface of the flow passage member 4, and a liquid is supplied from the openings 5*a*.

The piezoelectric actuator substrate 21 which includes the displacement elements 30 is bonded to the upper surface of the flow passage member 4, and the displacement elements 30 are disposed so as to be positioned above the pressurizing chambers 10. Signal transmission parts 92 formed of an FPC (Flexible Printed Circuit) or the like which supply signals to the respective displacement elements 30 are connected to the piezoelectric actuator substrate 21. In FIG. 2, to facilitate the understanding of a state where two signal transmission parts 92 are connected to the piezoelectric actuator substrate 21, profiles of areas in the vicinity of portions where signal transmission parts 92 are connected to the piezoelectric actuator substrate 21 are indicated by a dotted line. Electrodes which are electrically connected to the piezoelectric actuator substrate 21 and are formed in the signal transmission part 92 are arranged in a rectangular shape on end portions of the signal transmission parts 92. Two signal transmission parts 92 are connected to the piezoelectric actuator substrate 21 in such a manner that the respective ends of the signal transmission parts 92 reach a center portion of the piezoelectric actuator substrate 21 in a short side direction. Two signal transmission parts 92 extend toward long sides of the piezoelectric actuator substrate 21 from the center portion of the piezoelectric actuator substrate 21.

A driver IC is mounted on the signal transmission part 92. The driver IC is mounted in such a manner that the driver IC is pressed to the metal-made housing and hence, heat of the driver IC is transferred to the metal-made housing and is radiated to the outside. A drive signal used for driving the displacement elements 30 mounted on the piezoelectric actuator substrate 21 is generated in the driver IC. A signal which controls the generation of a drive signal is generated by the control part 100, and the signal is inputted to ends of the signal transmission parts 92 on a side opposite to aside where the signal transmission parts 92 are connected to the piezoelectric actuator substrate 21. In the liquid ejection head 2, a printed circuit board or the like is disposed between the control part 100 and the signal transmission part 92 when necessary.

It is desirable that the reservoir 40 have, to supply a liquid to the openings 5*a* formed on both end portions of the head body 2*a*, a flow passage which allows a liquid to enter the reservoir 40 from one end portion of the reservoir in the long side portion, extends to a center portion of the reservoir in the long side direction once and, thereafter, extends toward a head body 2*a* side at the center portion, is branched and the branched flow passage communicates with the head body 2*a*. With such a configuration, the difference in length between the flow passages after branching becomes small and hence, irregularities in an ejection characteristic depending on a position in the head body 2*a* can be made small. Further, a liquid is introduced to the reservoir 40 from the outside at the end portion of the reservoir 40 and hence, a damper and a filter can be provided in the middle of the flow passage from the end portion to the portion where the flow passage is branched and, at the same time, a space can be formed above the center portion of the reservoir 40 so that a printed circuit board which is connected to the signal transmission parts 92 or the like can be arranged in the space. Further, by arranging the position where a liquid is introduced into the reservoir 40 at the end portion of the reservoir 40, a tube or the like for supplying a liquid to be ejected can be easily connected to the reservoir 40.

With such a configuration, the reservoir flow passage 41 is arranged so as to extend along the long side direction from the center portion of the liquid ejection head 2 to the end portion of the liquid ejection head 2 in the long side direction. The branched flow passage 42 is arranged so as to extend along the long side direction from one end portion of the liquid ejection head 2 in the long side direction to other end portion of the liquid ejection head 2 in the long side direction. The branched flow passage 42 is connected to the reservoir flow passage 41 by a connection portion 43 at the center portion of the liquid ejection head 2 in the long side direction. Since the reservoir flow passage 41 and the branched flow passage 42 extend along the same direction, when the reservoir flow passage 41 and the branched flow passage 42 are connected to each other directly, a liquid is liable to flow into the branched flow passage 42 having the same flow direction as the reservoir flow passage 41 thus causing difference in flow rate. Due to such a difference, at the time of supplying a liquid into the liquid ejection head 2 firstly, spreading of the liquid becomes non-uniform thus giving rise to a drawback that air bubbles are liable to remain in the flow passage, a drawback that an ejection speed on one side of the liquid ejection head is increased at the time of ejecting the liquid or a drawback that an ejection amount of the liquid is increased.

In view of the above-mentioned possibility, in a plan view of the ejection head body 2*a* (in viewing the ejection head body 2*a* from a reservoir 40 side), at least one of the reservoir flow passage 41 and the branched flow passage 42 in the vicinity of the connection portion 43 is bent such that an angle made by the reservoir flow passage 41 and the branched flow passage 42 at the connection portion 43 approximates 90 degrees. With such a configuration, the difference in flow rate can be made small. Such an angle may preferably be set to a value which falls within a range of 90±45 degrees, more preferably to a value which falls within a range of 90 degrees ±30 degrees, and still more preferably to a value which falls within a range of 90 degrees ±20 degrees. The reservoir flow passage 41 may be bent in such a manner that, for example, the reservoir flow passage 41 advances in the short side direction in the course of advancing toward the center portion in the long side direction. The branched flow passage 42 may be bent in such a manner that, for example, the branched flow passage 42 is bent two times so as to form an S shape and the connection portion 43 may be formed at a center portion between such bent portions formed by such two-time bending. In this case, by forming a straight portion between two bent portions and by forming the connection portion 43 at such a straight portion, the flow of a liquid can be made more uniform. A size of the straight portion outside an edge of the connection portion 43 may preferably be set equal to or more, further, two times or more than a size of a portion of the connection portion 43 having the largest size in cross section (in this embodiment, a diameter of the connection portion 43 since the connection portion 43 has a circular sectional shape).

The reservoir flow passage 41 has the structure extending along an imaginary straight line L10 except for a portion thereof in the vicinity of the connection portion 43. The reservoir flow passage 41 is bent in the direction along an imaginary straight line L3 in the vicinity of the connection portion 43. A bent angle is an angle made by the imaginary straight lines L10, L3. In this embodiment, the bent angle is set to 60 degrees. The bent angle may preferably be set to 10 degrees or more such that an angle made by the reservoir flow passage 41 and the branched flow passage 42 in the vicinity of the connection portion 43 approximates 90 degrees.

The branched flow passage 42 has the structure extending along an imaginary straight line L1 except for a portion thereof in the vicinity of the connection portion 43. The branched flow passage 42 is bent in the vicinity of the connection portion 43 such that an angle which the branched flow passage 42 makes with respect to the imaginary straight line L3 which extends in the direction of the reservoir flow passage 41 in the vicinity of the connection portion 43 approximates 90 degrees. The bent angle is an angle made by the imaginary straight lines L1 and L4. In this embodiment, the bent angle is 30 degrees. The bent angle is preferably set to 10 degrees or more so as to make an angle made by the reservoir flow passage 41 and the branched flow passage 42 in the vicinity of the connection portion 43 approximate 90 degrees. Although either one of the reservoir flow passage 41 or the branched flow passage 42 may be bent, in this case, a length of the liquid ejection head 2 in the short side direction is to be increased so as to make an angle between the reservoir flow passage 41 and the branched flow passage 42 approximate an angle near 90 degrees. By bending both the reservoir flow passage 41 and the branched flow passage 42, it is possible to arrange both the reservoir flow passage 41 and the branched flow passage 42 within a narrow width.

The above-mentioned structure is more effective in the case where a length of the reservoir flow passage 41 directed toward the connection portion 43 and also directed toward a head body 2*a* side (lower side) is smaller than a diameter of the opening. Although non-uniformity can be reduced by increasing the length of the reservoir flow passage 41, a height of the liquid ejection head 2 is increased. Further, by providing a straight line portion to a portion of the reservoir flow passage 41 between the bent portion and the connection portion 43, the flow of liquid is fixed to such a direction and hence, the formation of the straight line portion is desirable. A length of the straight line portion of the reservoir flow passage 41 from the bent portion to a portion closest to the connection portion 43 may preferably be set equal to or two or more times as large as a width of the reservoir flow passage 41 at such a portion.

In FIG. 6(*b*) and FIG. 6(*d*), the direction that a liquid in the reservoir flow passage 41 flows toward the connection portion 43 is indicated by the imaginary straight line L3, and the direction that a liquid in the branched flow passage 42 flows in the connection portion 43 is indicated by the imaginary straight line L4. The imaginary straight lines L3 and L4 make a right angle therebetween.

The reservoir 40 is formed by stacking a reservoir body 41*a* and plates 40*b* to 40*d*. Although these members can be bonded to each other by adhesion, such a step can be simplified by fastening using bolts. In this case, a soft member such as an O ring is arranged around the connection portion 43, and the soft member is deformed by a pressure generated by the bolts thus minimizing a leakage of a liquid. The same leakage preventing effect can be acquired by pressurizing the reservoir body 41*a* or the plates 40*b*, 40*c*. In any case, it is preferable to arrange the bolt fastening positions such that a pressure applied to the connection portion 43 becomes uniform.

In this embodiment, a first member which is the reservoir body 41*a* (mainly) forming the reservoir flow passage 41 and a second member which is a group of plates 40*b*, 40*c* forming the branched flow passage 42 are fastened to each other by the bolts. The plates 40*b* to 40*d* are stacked to each other by adhesion. The whole reservoir 40 may be assembled by bolts.

The bolts fastening positions 40*aa*, 40*ba*, 40*ca* are arranged so as to sandwich the branched flow passage 40 therebetween. That is, the bolt fastening positions 40*aa*, 40*ba*, 40*ca* are arranged in regions which are defined between the imaginary straight line L1 parallel to the long side direction of the liquid ejection head 2 which passes the connection portion 43 and the imaginary straight line L2 (overlapping with the imaginary straight line L3 in this embodiment) perpendicular to the imaginary straight line L4 which is the direction that a liquid in the branched flow passage 42 flows in the connection portion 43 and where an angle made by the imaginary straight line L1 and the imaginary straight line L3 is an acute angle. Two regions are provided with the connection portion 43 sandwiched therebetween. By arranging the bolt fastening positions 40*aa*, 40*ba*, 40*ca* in this manner, a pressure applied to the periphery of the connection portion 43 can be made approximately uniform and, at the same time, a size of the liquid ejection head 2 in the short side direction can be reduced.

Further, by arranging the bolt fastening positions 40*aa*, 40*ba*, 40*ca* within a range where the branched flow passage 42 is present in the short side direction of the liquid ejection head 2, a width of the liquid ejection head 2 in the short side direction can be reduced. That is, in FIG. 6(*d*), the bolt fastening positions are arranged between the imaginary straight lines L5, L6 parallel to the long side direction which define a range where the branched flow passage 42 bent in the vicinity of the connection portion 43 exists. That is, the branched flow passage 42 is bent two times in an S shape, and the bolt fastening positions are arranged at such respective bent portions and hence, a size of the liquid ejection head 2 in the short side direction can be reduced.

As will be described later, to supply a liquid to two respective manifolds 5 formed in the head body 2*a* or the like, two reservoir flow passages 41 and two branched flow passages 42 may be provided. In this case, by arranging the branched flow passages 42 parallel to each other in the short side direction of the liquid ejection head 2 and by arranging the reservoir flow passage 41 such that a liquid is supplied from different ends of the reservoir 40 in the long side direction and a liquid flows toward a center portion of the reservoir 40 in the long side direction, use efficiency of the space can be enhanced and hence, a size of the liquid ejection head 2 in the short side direction can be reduced. Alternatively, the large reservoir 40 can be formed while allowing the liquid ejection head 2 to have the same size in the short side direction. Further, by setting the same direction of bending at the connection portion 43 between the branched flow passages 42, the branched flow passages 42 can be arranged close to each other and hence, the size of the liquid ejection head 2 can be reduced in the short side direction. Further, the reservoir flow passages 41 and branched flow passages 42 may be provided in even numbers respectively, and may be arranged as described above such that two reservoir flow passages 41 form one pair and two branched flow passages 42 form one pair.

Further, one reservoir flow passage 41 is bent toward the connection portion 43 such that the reservoir flow passage 41 is directed toward one side in the short side direction from the center portion of the reservoir 40 in the short side direction, and the other reservoir flow passage 42 is bent toward the connection portion 43 such that the reservoir flow passage 42 is directed toward the other side in the short side direction from the center portion of the reservoir 40 in the short side direction. With such a configuration, two reservoir flow passages 41 can be efficiently arranged at the center portion of the reservoir 40 in the long side direction and hence, the size of the liquid ejection head 2 can be reduced.

Further, by mounting an elastically deformable damper 46 on a surface of a portion of the reservoir flow passage 41, when an ejection amount is largely changed, the supply of a liquid can be made stable. By forming the reservoir flow passage 41 into a triangular shape which spreads toward an end portion from the center portion of the liquid ejection head 2 in the long side direction and by also forming the damper 46 into a triangular shape which conforms to the shape of the reservoir flow passage 41, a capacity of the damper 46 can be increased. Further, the reservoir flow passage 41 is formed into the shape which is squeezed toward the connection portion 43 and hence, a liquid which flows toward the connection portion 43 minimally stagnates.

The reservoir flow passage 41 is divided into a first reservoir flow passage 41*b* into which a liquid flows from the outside, and a second reservoir flow passage 41*c* communicated with the connection portion 43. The first reservoir flow passage 41*b* has a triangular planar shape, and a lower surface of the first reservoir flow passage 41*b* forms the damper 46. The second reservoir flow passage 41*c* is arranged above the first reservoir flow passage 41*b*, and includes the straight line portion which extends along one side of the triangular first reservoir flow passage 41*b* extending toward the connection portion 43 and the bent portion communicated with the connection portion 43 from the straight line portion. A filter 48 may be provided between the first reservoir flow passage 41*b* and the second reservoir flow passage 41*c*. The second reservoir flow passage 41*c* is arranged in an upwardly projecting portion of the reservoir body 40*a*.

A discharge port 41*e* which opens to the outside may be formed at an end of the second reservoir flow passage 41*c* in the long side direction of the liquid ejection head 2. Air bubbles in the reservoir flow passage 41, particularly air bubbles which are likely to be generated in the filter 48 can be discharged through the discharge port 41*e*. The discharge port 41*e* is opened at the time of supplying a liquid into the reservoir 40 firstly so as to discharge air bubbles and a part of the liquid. At the time of performing the ejection of a liquid, the discharge port 41*e* is closed usually. However, the discharge port 41*e* may be opened when necessary. To facilitate the discharge of air bubbles, an upper surface of the second reservoir flow passage 41*c* is inclined toward the discharge port 41*e*.

On an upper surface of a portion of the reservoir body 40*a* which forms the second reservoir flow passage 41*c*, to facilitate forming of the reservoir body 40*a* using a resin, a hole is formed. The hole is closed by a hard lid 44.

In the reservoir 40, plural pairs of flow passages each formed of two reservoir flow passages 41 and two branched flow passages 42 as described above may be formed.

The head body 2*a* has one piezoelectric actuator substrate 21 which includes the flat plate-like flow passage member 4 and the displacement elements 30 connected to the flow passage member 4. A planar shape of the piezoelectric actuator substrate 21 is a rectangular shape, and the piezoelectric actuator substrate 21 is arranged on an upper surface of the flow passage member 4 such that long sides of the rectangular shape extends along the long side direction of the flow passage member 4.

Two manifolds 5 are formed in the inside of the flow passage member 4. The manifold 5 has an elongated shape extending from one end portion side to the other end portion side of the flow passage member 4 in the long side direction. The openings 5*a* of the manifold 5 open at an upper surface of the flow passage member 4 at both end portions. By supplying a liquid to the flow passage member 4 from both end portions of the manifold 5, a shortage of supply of a liquid minimally occurs. Further, compared to the case where a liquid is supplied from one end of the manifold 5, the difference in a pressure loss generated when a liquid flows through the manifold 5 can be almost halved and hence, the irregularities in a liquid ejection characteristic can be reduced. To reduce the difference in a pressure loss, it may be considered that a liquid is supplied to the manifold 5 at the center of the manifold 5 or a liquid is supplied to the manifold 5 at several points arranged along the manifold 5. However, such structures increase a width of the liquid ejection head 2, and the expansion of the arrangement of the ejection ports 8 in the width direction of the liquid ejection head 2 is also increased. Such arrangement increases the influence which the displacement of an angle at which the liquid ejection head 2 is mounted on the printer 1 exerts on a printing result and hence, the arrangement is not desirable. Also in printing using a plurality of liquid ejection heads 2, an area where all ejection port 8 of the plurality of liquid ejection heads 2 are arranged is expanded and hence, the influence which the accuracy of the relative position among the plurality of liquid ejection heads 2 exerts on a printing result is increased and hence, such arrangement is not desirable. Accordingly, to reduce the difference in pressure loss while reducing a width of the liquid ejection head 2, it is desirable to supply a liquid from both ends of the manifold 5.

Further, a center portion of the manifold 5 in the length direction which is a region communicated with at least the pressurizing chamber 10 is partitioned by partitioning walls 15 disposed in a spaced-apart manner in the width direction. In the center portion of the manifold 5 in the length direction which is the region communicated with the pressurizing chamber 10, the partitioning walls 15 have the same height as the manifold 5 thus completely partitioning the manifold 5 into a plurality of sub manifolds 5*b*. With such a configuration, as viewed in a plan view, a descender which is communicated with the ejection ports 8 and the pressurizing chamber 10 through the ejection ports 8 can be provided such that the descender overlaps with the partitioning wall 15.

In FIG. 2, the whole manifold 5 is partitioned by the partitioning walls 15 except for both end portions of the manifold 5. Besides such a configuration, portions of the manifold 5 except for one end portion out of both end portions may be partitioned by the partitioning walls 15. Further, it may be also possible to adopt the configuration where only an area in the vicinity of the opening 5*a* which opens to an upper surface of the flow passage member 4 is not partitioned, and partitioning walls are formed in the course of extending in the depth direction of the flow passage member 4 from the opening 5*a*. In any case, due to the formation of the portion which is not partitioned, flow passage resistance is reduced and a supply amount of liquid can be increased and hence, it is desirable that both end portions of the manifold 5 be not partitioned by the partitioning walls 15.

The manifolds 5 at plural divided portions may be also referred to as sub manifolds 5*b*. In this embodiment, two independent manifolds 5 are provided and the opening 5*a* is formed on both end portions of each manifold 5. Seven partitioning walls 15 are formed on one manifold 5 and hence, the manifold 5 is divided into eight sub manifolds 5*b*. A width of the sub manifold 5*b* is set larger than a width of the partitioning wall 15 and hence, it is possible to make a large amount of liquid flow through the sub manifold 5*b*. Further, with respect to seven partitioning walls 15, the closer to the center of the manifold 5 in the width direction the partitioning wall 15 is, the larger a length of the partitioning wall 15 becomes. At both ends of the manifold 5, the closer to the center of the manifold 5 in the width direction the partitioning wall 15 is arranged, the closer to the end of the manifold 5 an end portion of the partitioning wall 15 is disposed. With such a configuration, a balance is established between flow passage resistance generated by an outside wall of the manifold 5 and flow passage resistance generated by the partitioning wall 15 and hence, among the respective sub manifolds 5*b*, the difference in liquid pressure at an end of a region where the individual supply flow passage 14 which is a portion communicated with the pressurizing chamber 10 is formed can be reduced. The pressure difference in the individual supply flow passage 14 leads to the pressure difference applied to a liquid in the pressurizing chamber 10 and hence, irregularities in ejection can be reduced by reducing the pressure difference in the individual supply flow passage 14.

The opening 5*a* which supplies a liquid to the manifolds 5 arranged in the short side direction is arranged over the direction which intersects with the long side direction of the flow passage member 4 at both end portions of the head body 2*a* and hence, it is possible to supply a liquid in a stable manner to ends of the manifold 5 in the width direction. The opening 5*a* may be configured such that a long opening is continuously formed by arranging the opening 5*a* having the substantially same length as a width of the manifold 5 in the short side direction of the flow passage member 4 or short openings are intermittently formed.

In the flow passage member 4, the plurality of pressurizing chambers 10 are formed in a two dimensionally expanding manner. The pressurizing chamber 10 is a hollow region having an approximately rhombic planar shape with rounded corner portions.

The pressurizing chamber 10 is communicated with one sub manifold 5*b* through the individual supply flow passage 14. A pressurizing chamber row 11 which is a row of pressurizing chambers 10 communicated with the sub manifold 5*b* is arranged along one sub manifold 5*b* such that one pressurizing chamber row 11 is arranged on both sides of the sub manifold 5*b*, that is, two pressurizing chamber rows 11 in total are provided. Accordingly, sixteen pressurizing chamber rows 11 are provided for one manifold 5, and thirty-two pressurizing chamber rows 11 are provided for the whole head body 2*a*. Intervals between the pressurizing chambers 10 in the long side direction in each pressurizing chamber row 11 are equal. For example, the intervals are set to 37.5 dpi.

A dummy pressurizing chamber 16 is provided at ends of each pressurizing chamber row 11. Although the dummy pressurizing chamber 16 is communicated with the manifold 5, the dummy pressurizing chamber 16 is not communicated with the ejection port 8. Further, outside thirty-two pressurizing chamber rows 11, a dummy pressurizing chamber row where the dummy pressurizing chambers 16 are arranged on a straight line is provided. These dummy pressurizing chambers 16 are communicated with neither the manifold 5 nor the ejection ports 8. With a formation of these dummy pressurizing chambers, the structure (rigidity) of the periphery of the pressurizing chamber 10 which is disposed away from the end toward the inside by one becomes similar to the structure (rigidity) of other pressurizing chambers 10 and hence, the difference in liquid ejection characteristic can be reduced. With respect to the influence exerted by the difference in the peripheral structure, the influence of the pressurizing chambers 10 which are near to each other and are arranged adjacently to each other in the length direction is large and hence, the dummy pressurizing chamber is provided at both ends in the length direction. The influence is relatively small in the width direction and hence, the dummy pressurizing chamber is provided only at a portion close to the end of the head body 21*a*. Accordingly, a width of the head body 21*a* can be reduced.

The pressurizing chambers 10 communicated with one manifold 5 are arranged in matrix formed of lines and rows extending along respective outer sides of the rectangular piezoelectric actuator substrate 21. Due to such arrangement, individual electrodes 25 formed on the pressurizing chambers 10 are arranged at an equal distance from the outer sides of the piezoelectric actuator substrate 21 and hence, at the time of forming the individual electrode 25, the piezoelectric actuator substrate 21 is minimally deformed. When such deformation is large, at the time of bonding the piezoelectric actuator substrate 21 and the flow passage member 4 to each other, a stress is applied to the displacement element 30 closest to the outer side and hence, there is a possibility that irregularities arise with respect to a displacement characteristic. However, by reducing the deformation of the piezoelectric actuator substrate 21, the irregularities in displacement characteristic can be reduced. Further, the dummy pressurizing chamber row formed of the dummy pressurizing chambers 16 is provided outside the pressurizing chamber row 11 close to the outermost side and hence, a displacement characteristic is minimally influenced by the deformation of the piezoelectric actuator substrate 21. The pressurizing chambers 10 belonging to the pressurizing chamber row 11 are arranged at equal intervals, and the individual electrodes 25 corresponding to the pressurizing chamber row 11 are also arranged at equal intervals. The pressurizing chamber rows 11 are arranged at equal intervals in the short side direction, and the rows of individual electrodes 25 which correspond to the pressurizing chamber rows 11 are also arranged at equal intervals in the short side direction. With such a configuration, portions where the influence of crosstalk is particularly large can be eliminated.

In this embodiment, the pressurizing chambers 10 are arranged in a matrix array. However, the pressurizing chambers 10 may be arranged in a staggered manner such that a corner portion of the pressurizing chamber 10 is positioned between the pressurizing chambers 10 belonging to pressurizing chamber rows 11 arranged adjacently to each other. Due to such an arrangement, a distance between the pressurizing chambers 10 belonging to the pressurizing chamber rows 11 arranged adjacently to each other is further elongated thus suppressing crosstalk more effectively.

Irrespective of the arrangement of the pressurizing chamber rows 11, by arranging the pressurizing chamber 10 such that, as viewed in a plan view of the flow passage member 4, the pressurizing chambers 10 belonging to one pressurizing chamber row 11 do not overlap with the pressurizing chambers 10 belonging to the neighboring pressurizing chamber row 11 in the long side direction of the liquid ejection head 2, crosstalk can be suppressed. On the other hand, when a distance between the pressurizing chamber rows 11 is increased, a width of the liquid ejection head 2 is increased and hence, the influence which the accuracy of amounting angle of the liquid ejection head 2 on the printer 1 or the accuracy of the relative position of the liquid ejection heads 2 when a plurality of liquid ejection heads 2 are used exerts on a printing result is increased. Accordingly, it is possible to reduce the influence which these accuracies exert on the printing result by making a width of the partitioning wall 15 smaller than a width of the sub manifold 5*b*.

The pressurizing chambers 10 communicated with one sub manifold 5*b* form the pressurizing chamber rows 11 in two rows, wherein the ejection ports 8 communicated with the pressurizing chamber 10 belonging to one pressurizing chamber row 11 form one ejection port row 9. The ejection ports 8 communicated with the pressurizing chambers 10 belonging to the pressurizing chamber rows 11 in two rows respectively open on different sides of the sub manifold 5*b*. In FIG. 4, the ejection port rows 9 in two rows are formed in the partitioning wall 15, and the ejection ports 8 belonging to the respective ejection port rows 9 are communicated with the sub manifold 5*b* on a side close to the ejection ports 8 through the pressurizing chamber 10. By arranging such ejection ports 8 such that the ejection ports 8 do not overlap with each other in the long side direction of the liquid ejection head 2 with the ejection ports 8 communicated with the neighboring sub manifold 5*b* through the pressurizing chamber row 11, crosstalk between the flow passages which make the pressurizing chambers 10 and the ejection ports 8 communicate with each other can be suppressed and hence, crosstalk can be further reduced. When all flow passages which make the pressurizing chambers 10 and the ejection ports 8 communicate with each other are arranged so as not to overlap with each other in the long side direction of the liquid ejection head 2, crosstalk can be further reduced.

Further, by arranging the pressurizing chambers 10 and the sub manifold 5*b* in an overlapping manner with each other as viewed in a plan view, a width of the liquid ejection head 2 can be reduced. By setting a ratio of an area of the sub manifold 5*b* overlapping with the pressurizing chamber 10 to the area of the pressurizing chamber 10 to 80% or more, or further, 90% or more, a width of the liquid ejection head 2 can be further reduced. A bottom surface of the pressurizing chamber 10 at a portion where the pressurizing chamber 10 and the sub manifold 5*b* overlap with each other has low rigidity compared to the case where the pressurizing chamber 10 and the sub manifold 5 do not overlap with each other and hence, there is a possibility that an ejection characteristic becomes irregular due to the difference in rigidity. By setting a ratio of an area of the pressurizing chamber 10 which overlaps with the sub manifold 5*b* to an area of the whole pressurizing chamber 10 substantially equal among the respective pressurizing chambers 10, it is possible to reduce irregularities in an ejection characteristic caused by a change in rigidity of the bottom surface which forms the pressurizing chamber 10. Here, "substantially equal" means that the difference in area ratio is 10% or less, particularly 5% or less.

A pressurizing chamber group is formed of a plurality of pressurizing chambers 10 communicated with one manifold 5. Since there are two manifolds 5, there are two pressurizing chamber groups. The arrangement of the pressurizing chambers 10 relating to ejection in the respective pressurizing chamber groups is equal, and the pressurizing chambers 10 are arranged in a translational manner in the short side direction. These pressurizing chambers 10 are arranged over the whole surface in a region of an upper surface of the flow passage member 4 which faces the piezoelectric actuator substrate 21 in an opposed manner although there are some portions such as portions between pressurizing chamber groups where a distance is slightly increased. That is, the pressurizing chamber groups formed of these pressurizing chambers 10 occupy a region having the substantially same size and shape as the piezoelectric actuator substrate 21. Further, openings of the respective pressurizing chambers 10 are closed as the piezoelectric actuator substrate 21 is bonded to the upper surface of the flow passage member 4.

From a corner portion of the pressurizing chamber 10 disposed opposite to a corner portion with which the individual supply flow passage 14 is communicated, a descender communicated with the ejection port 8 which opens at an ejection port surface 4-1 formed on a lower surface of the flow passage member 4 extends. The descender extends in the direction away from the pressurizing chamber 10 as viewed in a plan view. To be more specific, the descender extends in the direction away from the pressurizing chamber 10 along an elongated diagonal line of the pressurizing chamber 10 while being laterally displaced with respect to the direction. With such a configuration, while arranging the pressurizing chambers 10 in a matrix array where intervals in each pressurizing chamber row 11 is set to 37.5 dpi, the ejection ports 8 can be arranged at intervals of 1200 dpi as a whole.

In other words, by projecting the ejection ports 8 orthogonal to an imaginary straight line parallel to the long side direction of the flow passage member 4, sixteen ejection ports 8 communicated with the respective manifolds 5, that is, thirty-two ejection ports 8 in total are arranged at equal intervals of 1200 dpi within a range of an imaginary straight line R shown in FIG. 4. With such a configuration, by supplying ink of the same color to all manifolds 5, an image can be formed with resolution of 1200 dpi in the long side direction as a whole. Further, one ejection port 8 communicated with one manifold 5 is arranged at equal intervals of 600 dpi within a range surrounded by an imaginary straight line R. With such a configuration, by supplying inks of different colors to the respective manifolds 5, an image of two colors can be formed with resolution of 600 dpi in the long side direction as a whole. In this case, with the use of two liquid ejection heads 2, an image of four colors can be formed with resolution of 600 dpi. Accordingly, printing accuracy is increased compared to the case where a liquid ejection head capable of printing with 600 dpi is used, and setting of printing can be also performed simply.

Individual electrodes 25 are respectively formed at positions which face the respective pressurizing chambers 10 on an upper surface of the piezoelectric actuator substrate 21. The individual electrode 25 is smaller than the pressurizing chamber 10 by one size. The individual electrode 25 includes an individual electrode body 25*a* having a shape substantially similar to a shape of the pressurizing chamber 10, and a lead electrode 25*b* led out from the individual electrode body 25*a*. The individual electrodes 25, in the same manner as the pressurizing chambers 10, form an individual electrode row and an individual electrode group. Further, on an upper surface of the piezoelectric actuator substrate 21, a common-electrode-use surface electrode 28 which is electrically connected with a common electrode 24 through via holes is formed. The common-electrode-use surface electrode 28 is formed in two rows along the long side direction at a center portion of the piezoelectric actuator substrate 21 in the short side direction, and is formed in one row along the short side direction in the vicinity of an end in the long side direction. In the drawing, the common-electrode-use surface electrode 28 is formed intermittently on a straight line. However, the common-electrode-use surface electrode 28 may be continuously formed on a straight line.

The piezoelectric actuator substrate 21 is desirably formed such that, as described later, a piezoelectric ceramic layer 21*a* in which the via holes are formed, the common electrode 24 and a piezoelectric ceramic layer 21*b* be stacked to each other, the stacked body is baked and, thereafter, individual electrodes 25 and the common-electrode-use surface electrodes 28 are formed in the same steps. The positional irregularities between the individual electrodes 25 and the pressurizing chambers 10 largely influence an ejection characteristic of the liquid ejection head 2. When the stacked body is baked after the individual electrodes 25 are formed on the stacked body, there is a possibility that the piezoelectric actuator substrate 21 is warped. When the warped piezoelectric actuator substrate 21 is bonded to the flow passage member 4, the piezoelectric actuator substrate 21 is brought into a stress applied state so that there is a possibility that the irregularities occur in displacement by being influenced by the stress. In view of the above, the individual electrodes 25 are formed after the stack body is baked. In the same manner, the common-electrode-use surface electrodes 28 also have a possibility of warping. Further, by forming the common-electrode-use surface electrodes 28 simultaneously with the individual electrodes 25, positional accuracy is enhanced and the number of steps can be reduced. Accordingly, the individual electrodes 25 and the common-electrode-use surface electrodes 28 are formed in the same steps.

To describe irregularities in position of the via holes due to a firing shrinkage which may occur at the time of baking the piezoelectric actuator substrate 21, irregularities in position of the via holes mainly occur in the long side direction of the piezoelectric actuator substrate 21. Accordingly, the common-electrode-use surface electrode 28 is formed at the center of the even number of manifolds 5. In other words, the common-electrode-use surface electrode 28 is formed at the center of the piezoelectric actuator substrate 21 in the short side direction. The common-electrode-use surface electrode 28 has an elongated shape extending in the long side direction of the piezoelectric actuator substrate 21 and hence, it is possible to prevent the occurrence of a case where the via holes and the common-electrode-use surface electrodes 28 are not electrically connected with each other due to the positional displacement.

Two signal transmission parts 92 are arranged and bonded to the piezoelectric actuator substrate 21 such that the respective signal transmission parts 92 are directed to the center of the piezoelectric actuator substrate 21 from two long sides of the piezoelectric actuator substrate 21. In this case, the signal transmission parts 92 can be easily connected to the piezoelectric actuator substrate 21 by forming and connecting connection electrodes 26 onto the lead electrodes 25*b* and by forming and connecting a common-electrode-use connection electrode onto the common-electrode-use surface electrode 28 of the piezoelectric actuator substrate 21. Also in this case, by setting an area of the common-electrode-use surface electrode 28 and an area of the common-electrode-use connection electrode larger than an area of the connection electrodes 26, end portions of the signal transmission part 92 and the piezoelectric actuator substrate 21 (distal end of the signal transmission part 92 and the end of the piezoelectric actuator substrate 21 in the long side direction) are connected more firmly due to the connection on the common-electrode-use surface electrode 28. Accordingly, it is possible to make the peeling off of the signal transmission part 92 starting from the end of the signal transmission part 92 difficult.

Further, the ejection ports 8 are arranged in the flow passage member 4 at positions which avoid a region facing the manifolds 5 arranged on a lower surface side of the flow passage member 4. The ejection ports 8 are arranged on the lower surface side of the flow passage member 4 within a region which faces the piezoelectric actuator substrate 21. These ejection ports 8, in the form of one group of ejection ports, occupy a region having the substantially same size and shape as the piezoelectric actuator substrate 21. By displacing the displacement elements 30 of the corresponding piezoelectric actuator substrate 21, liquid droplets can be ejected from the ejection ports 8.

The flow passage member 4 which forms a part of the head body 2*a* has the stacked structure where a plurality of plates are stacked. These plates are, in order from an upper surface of the flow passage member 4, a cavity plate 4*a*, a base plate 4*b*, an aperture (diaphragm) plate 4*c*, a supply plate 4*d*, manifold plates 4*e* to 4*j*, a cover plate 4*k* and a nozzle plate 41. A large number of ports are formed in these plates respectively. Thicknesses of the respective plates are approximately 10 to 300 μm and hence, forming accuracy of ports to be formed can be increased. The respective plates are positioned and stacked such that these ports formed in the respective plates are communicated with each other so as to form the individual flow passages 12 and the manifold 5. In the head body 2*a*, the pressurizing chamber 10 is formed in the upper surface of the flow passage member 4, the manifold 5 is formed in the inside of the flow passage member 4 on the lower surface side, and the ejection ports 8 are formed in a lower surface of the flow passage member 4. That is, the head body 2*a* has the configuration where the respective parts which constitute the individual flow passages 12 are arranged adjacently to each other at different positions so that the manifold 5 and the ejection port 8 are communicated with each other through the pressurizing chamber 10.

The holes formed in the respective plates are described. The holes are formed of the following holes. The first hole is the pressurizing chamber 10 formed in the cavity plate 4*a*. The second hole is a communication hole forming an individual supply flow passage 14 which is a communication passage ranging from one end of the pressurizing chamber 10 to the manifold 5. The communication hole is formed in the respective plates ranging from the base plate 4*b* (to be more specific, from an inlet of the pressurizing chamber 10) to the supply plate 4*d* (to be more specific, to an outlet of the manifold 5). The individual supply flow passage 14 includes a diaphragm 6. The diaphragm 6 is formed in the aperture plate 4*c*, and is a portion where a cross-sectional area of the flow passage is reduced.

The third hole is the communication hole forming the flow passage which is a communication passage ranging from the other end of the pressurizing chamber 10 to the ejection port 8. In the description made hereinafter, this communication hole is referred to as "descender (partial flow passage)". The descender is formed in the respective plates ranging from the base plate 4*b* (to be more specific, from an outlet of the pressurizing chamber 10) to the nozzle plate 41 (to be more specific, to the ejection port 8). With respect to the hole formed in the nozzle plate 41, the hole is formed as the ejection port 8. The ejection port 8 opens toward the outside the flow passage member 4, and has a diameter of 10 to 40 μm, for example, and the diameter of the ejection port 8 is increased toward the inside of the nozzle plate 41. The fourth hole is the communication hole which forms the manifold 5. The communication hole is formed in the manifold plates 4*e* to 4*j* respectively. The holes are formed in the manifold plates 4*e* to 4*j* such that partition portions which form the partitioning walls 15 remain so as to form the sub manifolds 5*b*.

The first to fourth communication holes are communicated with each other thus forming the individual flow passage 12 ranging from an inflow port through which a liquid from the manifold 5 flows (the outlet of the manifold 5) to the ejection port 8. A liquid supplied to the manifold 5 is ejected from the ejection port 8 through the following path. Firstly, the liquid flows in the upward direction from the manifold 5 and enters the individual supply flow passage 14, and reaches one end portion of the diaphragm 6. Next, the liquid advances horizontally along the extending direction of the diaphragm 6, and reaches the other end portion of the diaphragm 6. The liquid advances in the upward direction from the other end portion of the diaphragm 6, and reaches one end portion of the pressurizing chamber 10. Then, the liquid advances horizontally along the extending direction of the pressurizing chamber 10, and reaches the other end portion of the pressurizing chamber 10. The liquid mainly advances in the downward direction while gradually moving in the horizontal direction from the other end portion of the pressurizing chamber 10, and advances to the ejection port 8 which opens in the lower surface.

The piezoelectric actuator substrate 21 has the stacked structure formed of two piezoelectric ceramic layers 21*a*, 21*b* each of which is a piezoelectric body. These piezoelectric ceramic layers 21*a*, 21*b* respectively have a thickness of approximately 20 μm. A thickness from a lower surface of the piezoelectric ceramic layer 21*a* of the piezoelectric actuator substrate 21 to an upper surface of the piezoelectric ceramic layer 21*b* is approximately 40 μm. Both piezoelectric ceramic layers 21*a*, 21*b* extend over a plurality of pressurizing chambers 10 in a straddling manner. These piezoelectric ceramic layers 21*a*, 21*b* are made of a lead zirconate titanate (PZT) based ceramic material having ferroelectricity, for example.

The piezoelectric actuator substrate 21 includes: the common electrode 24 made of a metal material such as an Ag—Pd based metal material; and the individual electrodes 25 made of a metal material such as an Au based metal material. As described above, the individual electrodes 25 include: the individual electrode bodies 25*a* arranged on an upper surface of the piezoelectric actuator substrate 21 at positions which face the pressurizing chambers 10 in an opposed manner; and lead electrodes 25*b* which are led out from the individual electrode bodies 25*a*. Connection electrodes 26 are formed on one ends of the lead electrodes 25*b* at portions led out to the outside of regions facing the pressurizing chambers 10 in an opposed manner. The connection electrode 26 is made of silver-palladium containing glass frit, for example, has a thickness of approximately 15 μm, and is formed into a convex shape. The connection electrodes 26 are electrically connected to electrodes formed on the signal transmission part 92. Although the configuration of the individual electrodes 25 is described later in detail, drive signals are supplied to the individual electrodes 25 from the control part 100 through the signal transmission parts 92. The drive signals are supplied at a fixed cycle in synchronism with a conveying speed at which a print medium P is conveyed.

The common electrode 24 is formed over the substantially whole surface of a region between the piezoelectric ceramic layer 21*a* and the piezoelectric ceramic layer 21*b* in the plane direction. That is, the common electrode 24 extends so as to cover all pressurizing chambers 10 within a region which faces the piezoelectric actuator substrate 21. A thickness of the common electrode 24 is approximately 2 μm. The common electrode 24 is connected to the common-electrode-use surface electrode 28 formed on the piezoelectric ceramic layer 21*b* at positions which avoid an electrode group constituted of the individual electrodes 25 through a via hole formed in the piezoelectric ceramic layer 21*b*. The common electrode 24 is grounded so that a potential of the common electrode 24 is held at a ground potential. In the same manner as the large number of individual electrodes 25, the common-electrode-use surface electrode 28 is connected to another electrode on the signal transmission part 92.

As described later, when a predetermined drive signal is selectively supplied to the individual electrode 25, a volume of the pressurizing chamber 10 which corresponds to the individual electrode 25 changes whereby a pressure is applied to a liquid in the pressurizing chamber 10. Accordingly, liquid droplets are ejected from the corresponding liquid ejection port 8 through the individual flow passage 12. That is, portions of the piezoelectric actuator substrate 21 which face the respective pressurizing chambers 10 correspond to the individual displacement elements 30 which correspond to the respective pressurizing chambers 10 and the liquid ejection ports 8. That is, in the stacked body formed of two piezoelectric ceramic layers 21*a*, 21*b*, the displacement element 30 which is a piezoelectric actuator having the structure shown in FIG. 5 as the unit structure is provided for each pressurizing chamber 10. The displacement element 30 is formed of: a vibration plate 21*a* positioned directly above the pressurizing chamber 10; the common electrode 24; the piezoelectric ceramic layer 21*b*; and the individual electrode 25. The piezoelectric actuator substrate 21 includes a plurality of displacement elements 30 which are pressurizing portions. In this embodiment, an amount of liquid which is ejected from the liquid ejection port 8 each time an ejection operation is performed is approximately 1.5 to 4.5 pl (picoliter).

To control potentials of a large number of individual electrodes 25 individually, the respective individual electrodes 25 are electrically connected to the control part 100 individually via the signal transmission part 92 and lines. When a potential of the individual electrode 25 is made different from a potential of the common electrode 24 so that an electric field is applied to the piezoelectric ceramic layer 21*b* in the polarization direction, a portion of the piezoelectric ceramic layer 21*b* to which the electric field is applied acts as an activated portion which is distorted due to a piezoelectric effect. In such a configuration, when a positive predetermined potential or a negative predetermined potential is applied to the individual electrode 25 with respect to the common electrode 24 by the control part 100 such that an electric field and a polarization direction have the same direction, a portion of the piezoelectric ceramic layer 21*b* sandwiched between the electrodes (an activated portion) is contracted in the plane direction. On the other hand, the piezoelectric ceramic layer 21*a* which is a non-activated layer is not influenced by the electric field and hence, there is no possibility that the piezoelectric ceramic layer 21*a* is spontaneously contracted, and intends to restrict the deformation of the activated portion. As a result, the difference arises in distortion in the polarization direction between the piezoelectric ceramic layer 21*b* and the piezoelectric ceramic layer 21*a* and hence, the piezoelectric ceramic layer 21*b* is deformed so as to project toward a pressurizing chamber 10 side (unimorph deformation).

To describe actual driving steps of the liquid ejection head according to this embodiment, the individual electrode 25 is set to a potential higher than a potential of the common electrode 24 (hereinafter referred to as "high potential") in advance and, each time an ejection command is issued, the individual electrode 25 is temporarily set to the same potential as the common electrode 24 (hereinafter referred to as "low potential") and, thereafter, the individual electrodes 25 is set to a high potential again at a predetermined timing. Accordingly, at a timing where the individual electrode 25 becomes the low potential, the piezoelectric ceramic layers 21*a*, 21*b* return to original shapes and hence, a volume of the pressurizing chamber 10 is increased compared to an initial state (a state where potentials of both electrodes differ from each other). Due to such an operation, a negative pressure is applied to the pressurizing chamber 10 so that a liquid is sucked into the inside of the pressurizing chamber 10 from a manifold 5 side. Thereafter, at a timing where the potential of the individual electrode 25 is set to a high potential again, the piezoelectric ceramic layers 21*a*, 21*b* are deformed so as to project toward a pressurizing chamber 10 side so that the volume of the pressurizing chamber 10 is decreased whereby a pressure in the pressurizing chamber 10 becomes a positive pressure. Accordingly, a pressure applied to a liquid is increased so that liquid droplets are ejected. That is, to eject the liquid droplets, a drive signal which contains a pulse having a high potential as a reference potential is supplied to the individual electrode 25. It is ideal that a pulse width is set to an AL (Acoustic Length) which is a time length during which a pressure wave is propagated from the diaphragm 6 to the ejection port 8. With the use of the AL, both pressures are combined with each other when the inside of the pressurizing chamber 10 is inverted to a positive pressure state from a negative pressure state whereby the liquid droplets can be ejected at a higher pressure.

In performing gradation printing, gradation is expressed in accordance with the number of liquid droplets continuously ejected from the ejection ports 8, that is, an amount (volume) of liquid droplets adjusted based on the number of times of ejecting liquid droplets. Accordingly, liquid droplets are continuously ejected from the ejection ports 8 which correspond to a designated dot region the number of times corresponding to the designated gradation expression. In general, when the liquid ejection is continuously performed, it is preferable that an interval between pulses at which liquid droplets are ejected be set to an AL. In this case, a cycle of a residual pressure wave of a pressure generated in the preceding ejection of liquid droplets and a cycle of a pressure wave of a pressure generated in the post ejection of liquid droplets agree with each other so that these waves are superposed with each other whereby a pressure for ejecting liquid droplets can be amplified. In this case, it is considered that a speed of liquid droplets in post ejection of liquid droplets becomes faster. In such a case, a distance between impact points of the plurality of liquid droplets becomes near. Accordingly, it is preferable to set an interval between pulses at which liquid droplets are ejected to an AL.

In this embodiment, the displacement element 30 which makes use of the piezoelectric deformation is described as the pressurizing part. However, the pressurizing part is not limited to the displacement element 30. Provided that the pressurizing part can change a volume of the pressurizing chamber 10, that is, provided that the pressurizing part can apply a pressure to a liquid in the pressurizing chamber 10, the pressurizing part may take other means. For example, the pressurizing part may be formed of a means which generates a pressure by boiling a liquid in the pressurizing chamber 10 by heating, or a means which makes use of an MEMS (Micro Electro Mechanical Systems).

REFERENCE SIGNS LIST

1 printer
2 liquid ejection head
2*a* (liquid ejection) head body
4 flow passage member
4*a* to 1 plate (of flow passage member)
4-1 ejection port surface
4-2 pressurizing chamber surface
5 manifold (common flow passage)
5*a* opening
6 diaphragm
8 ejection port
9 ejection port row
10 pressurizing chamber
11 pressurizing chamber row
12 individual flow passage
14 individual supply flow passage
21 piezoelectric actuator substrate
21*a* piezoelectric ceramic layer (vibration plate)
21*b* piezoelectric ceramic layer
24 common electrode
25 individual electrode
25*a* individual electrode body
25*b* lead electrode
26 connection electrode
28 common-electrode-use surface electrode
30 displacement element (pressurizing portion)
40 reservoir
40*a* reservoir body
40*b* to *d* plate (of reservoir)
40*aa*, 40*ba*, 40*ca* bolt hole (fastening by bolts position)
41 reservoir flow passage
41*a* introducing hole (of reservoir flow passage)
41*b* first reservoir flow passage
41*c* second reservoir flow passage
41*d* discharge guide hole (of reservoir flow passage)
41*e* discharge port (of reservoir flow passage)
42 branched flow passage
42*a* discharge guide hole (of branched flow passage)
43 connection portion (between reservoir flow passage and branched flow passage)
44 lid (of second reservoir flow passage)
46 damper
48 filter

The invention claimed is:

1. A liquid ejection head comprising:
a liquid ejection head body; and
a reservoir mounted on the liquid ejection head body and supplying a liquid to the liquid ejection head body,
wherein the reservoir includes: a reservoir flow passage; and a branched flow passage arranged closer on a liquid ejection head body side than the reservoir flow passage,
the reservoir flow passage extends in one direction, opens to the outside at one end thereof, and is communicated with the branched flow passage at the other end thereof,
the branched flow passage extends in said one direction, and is communicated with the liquid ejection head body at both ends portion thereof, and
in viewing the liquid ejection head from a reservoir side, at least one of the reservoir flow passage and the branched flow passage in the vicinity of a connection portion where the reservoir flow passage and the branched flow passage are communicated with each other is bent so as to make an angle made by the reservoir flow passage and the branched flow passage approximate a right angle.

2. The liquid ejection head according to claim 1, wherein both the reservoir flow passage and the branched flow passage are bent in the vicinity of the connection portion such that an angle made by the reservoir flow passage and the branched flow passage approximates a right angle.

3. The liquid ejection head according to claim 2, wherein
the reservoir includes a first member forming the reservoir flow passage and a second member forming the branched flow passage, and the first member and the second member are fastened to each other by bolts,
in viewing the liquid ejection head from a reservoir side, fastening by bolts is performed at two or more bolt fastening positions across the branched flow passage, and the bolt fastening positions are arranged in a region which is defined between an imaginary straight line L1 which passes the connection portion and extends in said one direction and an imaginary straight line L2 which passes the connection portion and extends in a direction orthogonal to a direction that a liquid flows in the connection portion of the branched flow passage and where an angle made by the imaginary straight line L1 and the imaginary straight line L2 is an acute angle.

4. The liquid ejection head according to claim 2, wherein the bolt fastening positions are arranged in a range where the branched flow passage exists in the direction orthogonal to said one direction.

5. The liquid ejection head according to claim 2, wherein the reservoir includes a plurality of branched flow passages and a plurality of reservoir flow passages, and in the liquid ejection head as viewed in a plan view, the branched flow passages are arranged in a direction intersecting with said one direction, and portions of all of the branched flow passages in the vicinity of the connection portions are bent in the same direction.

6. The liquid ejection head according to claim 1, wherein, in a plan view of a liquid ejection head, a vicinity of the branched flow passage communicated with the reservoir flow passage is bent in an S shape, and the reservoir flow passage is communicated with the branched flow passage at a center portion of the S shape.

7. The liquid ejection head according to claim 1, wherein the liquid ejection head body extends in said one direction, the branched flow passage is communicated with the liquid ejection head body at both end portions of the liquid ejection head body, and the connection portion is arranged at a center portion of the branched flow passage in said one direction.

8. The liquid ejection head according to claim 1, wherein the reservoir includes a plurality of branched flow passages and a plurality of reservoir flow passages, and in the liquid ejection head as viewed from a reservoir side, the branched flow passages are arranged in a direction intersecting with said one direction, and in a state where each two branched flow passages are set as a pair sequentially from an end in the direction intersecting with said one direction, one reservoir flow passage in one pair is bent so as to extend in one of directions orthogonal to said one direction from a center portion of the reservoir in said directions orthogonal to said one direction toward the connection portion, and the other reservoir flow passage in said one pair is bent so as to extend in the other of directions orthogonal to said one direction from a center portion of the reservoir in said directions toward the connection portion.

9. The liquid ejection head according to claim 8, wherein in a plan view of the liquid ejection head, the reservoir flow passage is formed into a triangular shape having a width increasing toward an end of the reservoir, and a portion having the triangular shape is formed of a deformable damper.

10. A recording device comprising:

the liquid ejection head according to claim 1;

a conveyance part conveying a recording medium to the liquid ejection head; and a control part controlling the liquid ejection head.

* * * * *